US006055671A

United States Patent [19]

Fung-Ming

[11] Patent Number: 6,055,671

[45] Date of Patent: May 2, 2000

[54] FILLING TYPE PATTERNIZED GLOVE

[76] Inventor: Chiang Fung-Ming, 5F, No.80, Sec.2, Wuchang St., Taipei, Taiwan

[21] Appl. No.: 09/266,924

[22] Filed: Mar. 12, 1999

[30] Foreign Application Priority Data

Mar. 24, 1998 [CN] China ..... 98223534

[51] Int. Cl.[7] ..... A41D 19/00

[52] U.S. Cl. ..... 2/167; 2/159; 2/164

[58] Field of Search ..... 2/159, 160, 161.1, 2/161.5, 161.6, 167, 164, 169, DIG. 3, 910; 40/586

[56] References Cited

U.S. PATENT DOCUMENTS

| | | | |
|---|---|---|---|
| 3,259,914 | 7/1966 | Johnson | 2/159 |
| 3,869,594 | 3/1975 | Shively | 219/211 |
| 4,853,978 | 8/1989 | Stockum | 2/167 |
| 5,025,502 | 6/1991 | Raymond et al. | 2/159 |
| 5,526,536 | 6/1996 | Cartmill | 2/161.7 |
| 5,603,118 | 2/1997 | Solomon | 2/20 |
| 5,619,752 | 4/1997 | Haber et al. | 2/161.7 |
| 5,881,384 | 3/1999 | Williams | 2/158 |
| 5,898,942 | 5/1999 | Anderson | 2/159 |
| 5,911,848 | 6/1999 | Haber et al. | 156/245 |

*Primary Examiner*—Diana Oleksa
*Assistant Examiner*—Katherine Moran
*Attorney, Agent, or Firm*—Dougherty & Troxell

[57] ABSTRACT

A personal article, in particular a filling type patternized glove, includes an outer layer, a lining inner layer, a filling medium layer disposed intermediate of the outer and inner layer, and a filling medium filling and discharging controller. The outer layer has a surface provided with various decorative patterns of one or more colors formed by dyeing, printing or coating. The patterns together with a changeable filling medium in the filling medium layer enhance the decorative effect of the glove while providing a health-promoting function. Besides, the glove is made of a foldable material to facilitate carrying.

7 Claims, 2 Drawing Sheets

FILLING TYPE PATTERNIZED GLOVE

BACKGROUND OF THE INVENTION (a) Field of the Invention

The present invention relates to a personal article, more particularly to a filling type patternized glove adapted for daily use or as an accessory to go with clothing.

(b) Description of the Prior Art

Gloves are common articles. They protect the hands or keep them warm in cold weather. Some are for ornamental purposes. In general, a glove is comprised of one or two layers. A layer of cotton or other heat conserving or protective materials is provided between the two layers to provide warmth-keeping or protective functions. A glove as such is not for ornamental purposes and, limited by its own structure, does not allow any breakthrough in terms of being an ornamental accessory to clothing. In addition, carrying of such a glove is also a problem. In order to cater to consumers' taste for variety and multi-purpose products, it is desirable to have a glove that have various ornamental effects as well as health-promoting functions.

SUMMARY OF THE INVENTION

A primary object of the present invention is to provide a filling type patternized glove that provides a wide range of pattern combinations to enhance ornamental effects of the glove. Different media can be filled into the glove to create different special ornamental effects and to provide health-promoting functions. Besides, the glove of the present invention is foldable to facilitate carrying.

BRIEF DESCRIPTION OF THE DRAWINGS

The foregoing and other features and advantages of the present invention will be more clearly understood from the following detailed description and the accompanying drawings, in which.

DETAILED DESCRIPTION OF THE PREFERRED EMBODIMENT

Figure 1:
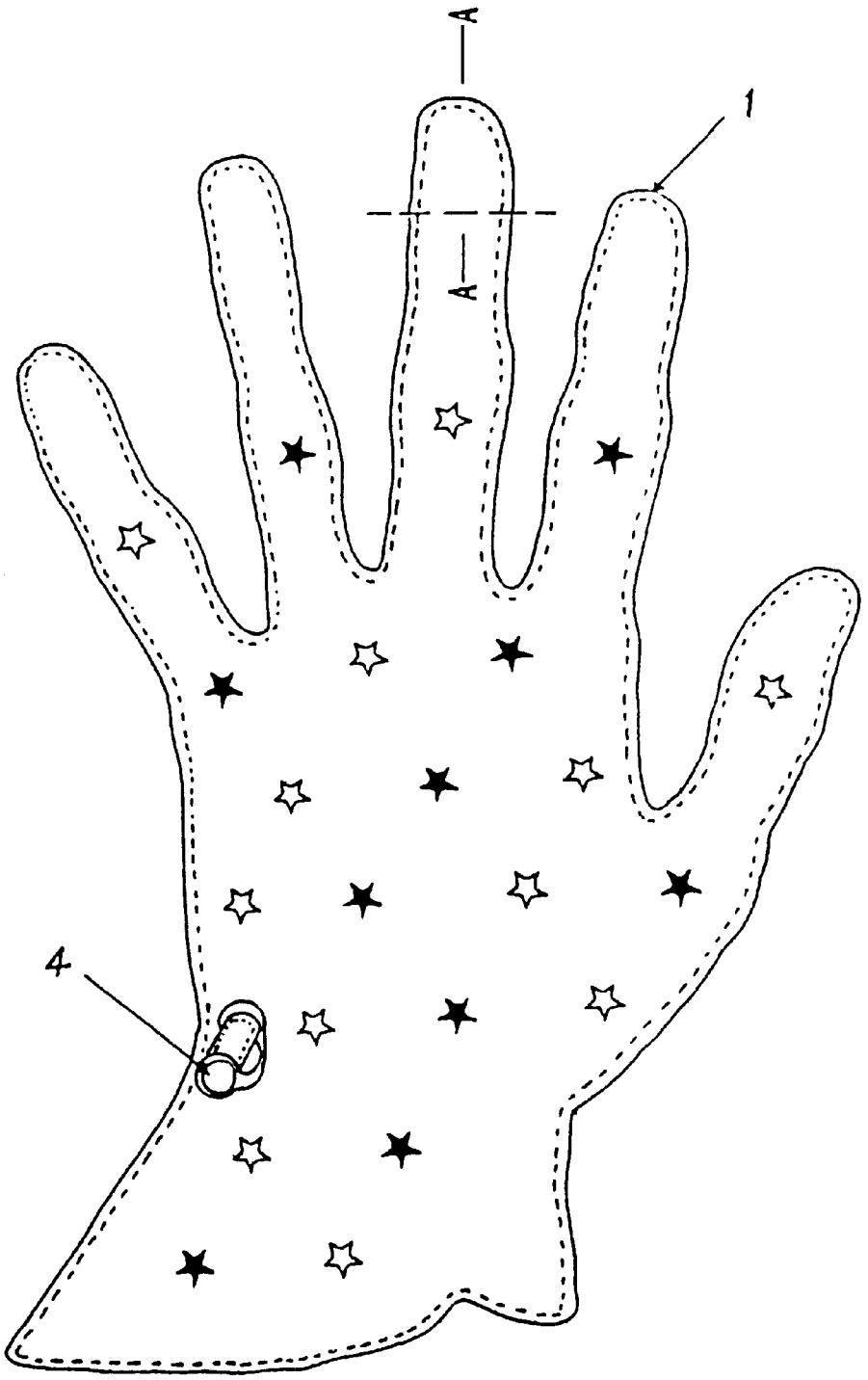
FIG. 1 is a plan view of a preferred embodiment of the glove of the present invention.
Figure 2:
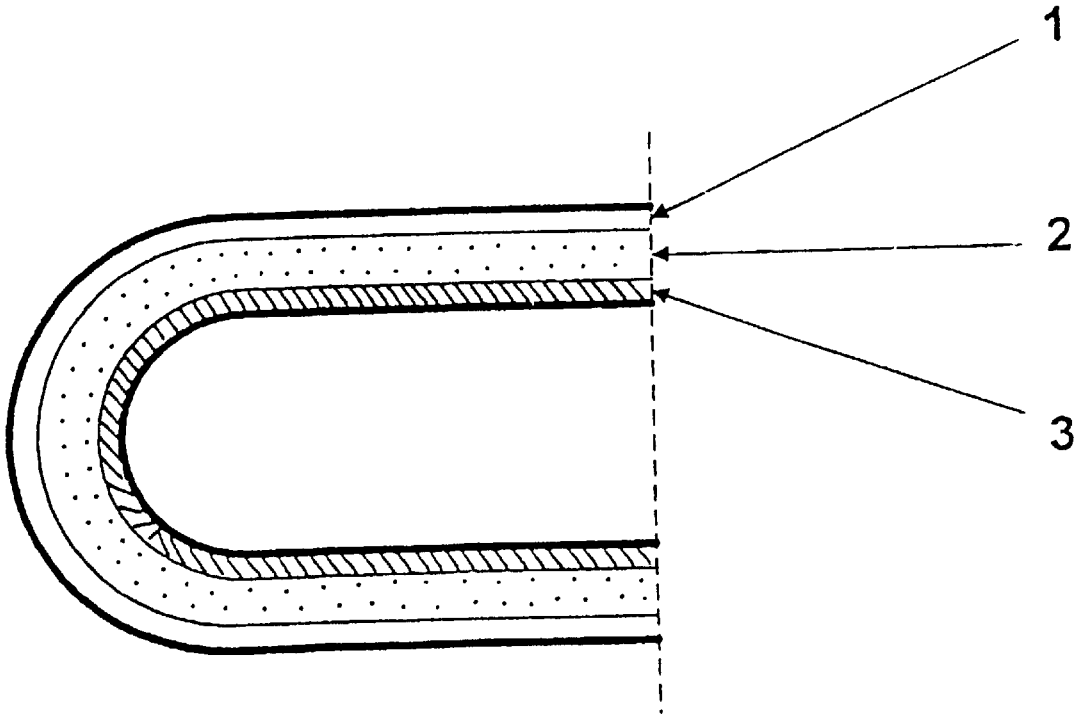
FIG. 2 is a sectional view taken along line A—A of FIG. 1.

With reference to FIGS. 1 and 2, a preferred embodiment of a filling type patternized glove according to the present invention is shown to include an outer layer 1, a lining inner layer 3, a stuffing medium layer 2 located between the outer and inner layers 1, 3, and a stuffing medium filling and discharging controller 4 that is disposed on either the outer layer 1 or the inner layer 3. The outer and inner layers 1, 3 may be configured to be transparent or non-transparent. The outer and inner layers 1, 3 may be formed from a natural or artificial material or a combination of both such that they are foldable. The outer layer 1 has a decorative pattern that is formed by dyeing, printing, or coating using points, lines, faces, words, signs, numerals, pictures or graphics or a combination thereof of one or more colors. Dyes or pigments can also be used to create a special optical visual effect. The filling medium may be a natural or artificial material in a gaseous, liquid or solid state, or any combination thereof. The filling medium may also be a natural or artificial material having a special physical effect, such as temperature, magnetic force, or health beneficial function. The filling medium enters or exits via the filling and discharging controller 4 provided on the outer layer 1 or the inner layer 3.

In the glove according to the present invention, the outer layer surface may have various pattern combinations that can be selected conveniently to match the user's clothing and accessories as to give variety and richness to the user's appearance. In addition, as different filling media can be selected to match the various pattern combinations, the glove of the present invention is endowed with multifarious ornamental effects while having health-promoting effects. Because of its various advantages, the glove of the present invention is adapted for use by users of all ages, in particular youngsters. Furthermore, the glove of the present invention is made of a foldable material to facilitate carrying.

Examples of the glove of the present invention and the effects achievable thereby are described as follows:

EXAMPLE 1

The outer and inner layers 1, 3 are formed from a transparent film or sheet of PE of a thickness of about 0.1–0.3 mm. The surface of the outer layer 1 is provided with a desired pattern using dyes or pigments by means of dyeing, printing or coating. Then, the outer and inner layers 1, 3 are made into a glove using a conventional method. The medium filling and discharging controller 4 is installed on the outer layer 1 or the inner layer 3 at a suitable position. As the medium filling and discharging controller 4 is a conventional product, a detailed description thereof is dispensed with herein.

In order to enhance the special effect of the decorative pattern, a liquid of dyes that have been pre-mixed is used as the filling medium and introduced into the filling medium layer 2 so that it matches the pattern on the surface of the outer layer 1 to highlight the pattern. The filling medium layer 2 can be filled with the filling medium in advance or at any time as desired. The filling medium can also be changed as desired. When the glove is not in use, the filling medium in the glove can be discharged using the medium filling and discharging controller 4 so that the glove can be rolled up to facilitate carrying.

EXAMPLE 2

The structure of the glove in this example is basically the same as that in Example 1 except that a suspension of tiny tinsels is added to the filling medium. In use, particularly in exercising, due to reflection and refraction of the tinsels in the filling medium, the glove appears glittery and eye-catching.

EXAMPLE 3

The structure of the glove in this example is basically the same as that in Example 1 except that a suspension of fine magnetic powders is added to the filling medium. Hence, apart from exhibiting a special ornamental effect, the glove of this example has magnetic therapeutic and health-promoting effects.

EXAMPLE 4

The structure of the glove in this example is basically the same as that in Example 1 except that the filling medium is a gaseous material that has been dyed or is transparent. The glove of this example displays another special ornamental effect.

EXAMPLE 5

The structure of the glove in this example is basically the same as that in Example 1 except that the filling medium is a solution of two different colored liquids that have different specific weights and that do not mix with each other. In use, especially in exercising or change in posture, the two liquids in the glove will, due to different physical properties, form changing patterns and color combinations so that the glove of this example appears livelier and aesthetically pleasing.

Although the present invention has been illustrated and described with reference to the preferred embodiments thereof, it should be understood that it is in no way limited to the details of such embodiments but is capable of numerous modifications within the scope of the appended claims.

What is claimed is:

1. A filling type patternized glove, comprising an outer layer, a lining inner layer, a filling medium layer disposed intermediate of said outer layer and said inner layer, and a filling medium filling and discharging controller provided on said inner layer.

2. The filling type patternized glove as defined in claim 1, wherein said outer layer is transparent or non-transparent, and is made from a natural or artificial material or a combination thereof, said outer layer being configured to be foldable.

3. A filling type patternized glove as defined in claim 2, wherein said outer layer has a surface provided with a decorative pattern of at least one color to create an optical visual effect.

4. The filling type patternized glove as defined in claim 1, wherein said outer layer has a surface provided with a decorative pattern of at least one color to create an optical visual effect.

5. The filling type patternized glove as defined in claim 1, wherein said lining inner layer is made from a natural or artificial material or a combination thereof and is configured to be foldable.

6. The filling type patternized glove as defined in claim 1, wherein said filling medium layer is filled with a filling medium of a natural or artificial material in a gaseous, liquid or solid state, or any combination thereof.

7. The filling type patternized glove as defined in claim 6, wherein said filling medium has special physical effects, such as temperature, magnetic force, or health-promoting functions.

* * * * *